United States Patent [19]

Kuroda et al.

[11] 4,448,099

[45] May 15, 1984

[54] WORK HANDLING METHOD

[75] Inventors: Naoki Kuroda, Kyoto; Kimihiro Tsuge, Inuyama, both of Japan

[73] Assignee: The Warner & Swasey Company, Cleveland, Ohio

[21] Appl. No.: 328,380

[22] Filed: Dec. 7, 1981

Related U.S. Application Data

[63] Continuation of Ser. No. 127,801, Mar. 6, 1980, abandoned.

[30] Foreign Application Priority Data

Mar. 24, 1979 [JP] Japan ..... 54-34722

[51] Int. Cl.[3] ..... B26D 5/20

[52] U.S. Cl. ..... 83/23; 83/27; 83/151; 83/207; 83/277

[58] Field of Search ..... 83/23, 27, 102, 109, 83/111, 151, 152, 153, 154, 155, 207, 257, 276, 277, 278

[56] References Cited

U.S. PATENT DOCUMENTS

| | | | |
|---|---|---|---|
| 693,099 | 2/1902 | Bayler | 83/277 X |
| 3,776,073 | 12/1973 | Runge | 83/278 X |
| 3,857,313 | 12/1974 | Endo | 83/277 |
| 3,874,260 | 4/1975 | Roch | 83/27 |
| 4,070,723 | 1/1978 | Jess et al. | 83/276 X |
| 4,252,040 | 2/1981 | Kiefer | 83/277 X |

FOREIGN PATENT DOCUMENTS

| | | | |
|---|---|---|---|
| 804681 | 4/1951 | Fed. Rep. of Germany | 83/155 |

*Primary Examiner*—Frederick R. Schmidt
*Assistant Examiner*—Robert P. Olszewski
*Attorney, Agent, or Firm*—Yount & Tarolli

[57] ABSTRACT

An improved method of operating an apparatus to cut sheet material workpieces eliminates the inadvertent dropping of a relatively small scrap or remainder portion of a workpiece into a clearance space between a pair of cutter blades and a discharge conveyor. Thus, a relatively large sheet metal workpiece is gripped by a holder which moves the workpiece relative to a pair of blades. The blades are moved relative to each other to cut the workpiece to form a product having a desired configuration. The product is dropped onto a discharge conveyor. In order to prevent a relatively small scrap piece remaining in the holder from being dropped into a space between the discharge conveyor and the blades, the holder is extended through the space between the blades to a location over the discharge conveyor and is opened to drop the scrap or remainder portion of the workpiece onto the discharge conveyor.

1 Claim, 1 Drawing Figure

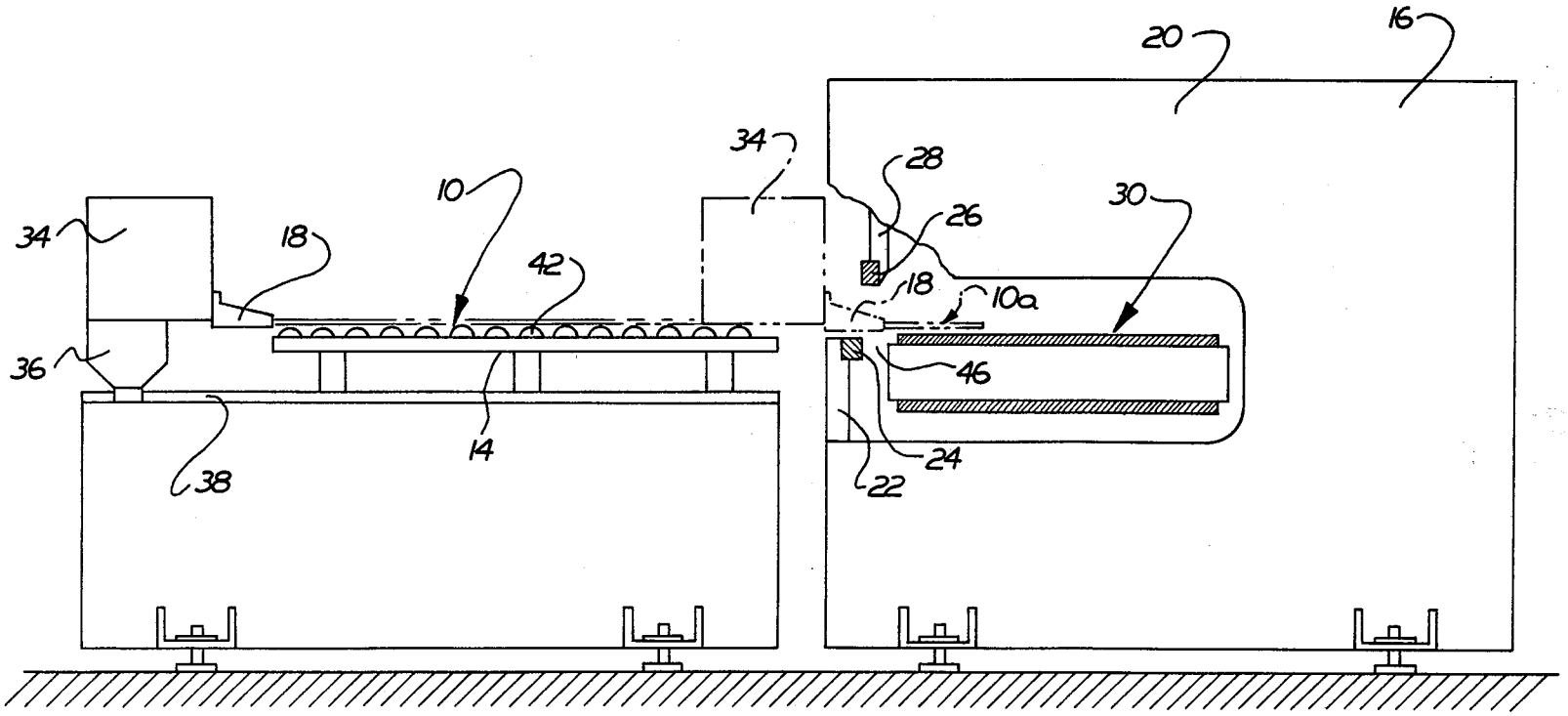
16
20
30
10a
46
26
28
18
24
22
34
42
10
14
18
38
34
36

WORK HANDLING METHOD

This is a continuation of application Ser. No. 127,801, filed Mar. 6, 1980, now abandoned.

BACKGROUND OF THE INVENTION

During the operation of shearing machines, holders are commonly utilized to move relatively large sheet metal workpieces relative to a pair of blades. Product pieces cut from the workpiece by the blades are dropped onto a discharge conveyor which is disposed on a side of the blades opposite from the holder. When a relatively small remainder or scrap piece remains in the holder, it is commonly opened and the scrap piece is dropped onto the discharge conveyor. Since the remainder or scrap piece is relatively small, it may inadvertently drop into the clearance space between the discharge conveyor and the blades.

SUMMARY OF THE PRESENT INVENTION

The present invention provides a new and improved method of operating a shearing machine in such a manner as to prevent the inadvertent dropping of scrap or remainder pieces into the clearance space between a discharge conveyor and the blades of the machine. In accordance with a feature of the invention, a holder which grips the workpiece is extended through the space between the blades to a location over a discharge conveyor. The holder is then opened to drop the relatively small remaining or scrap piece onto the discharge conveyor.

BRIEF DESCRIPTION OF THE DRAWING

The foregoing and other features of the present invention will become more apparent upon a consideration of the following description taken in connection with the accompanying drawing in which a shearing machine which is operated in accordance with the present invention is illustrated.

DESCRIPTION OF ONE SPECIFIC PREFERRED EMBODIMENT OF THE INVENTION

A rectangular sheet metal workpiece 10 is supported on a table 14 and is moved relative to a shearing machine 16 by movable holders 18. The shearing machine 16 includes a housing 20 having a base or frame 22 upon which a stationery lower blade 24 is mounted. A movable upper blade 26 is mounted on a frame member 28. The blade 26 is moved relative to the stationery blade 24 by a suitable drive mechanism (not shown). Relative movement between the lower blade 24 and upper blade 26 is used to cut the workpiece 10 to form product pieces which fall onto a discharge conveyor 30. Thus, when the blades 24 and 26 cut away a portion of the workpiece 10, the cut away portion falls onto the discharge conveyor 30 and is transported to a suitable receiving location.

During operation of the shearing machine 16, the holder 18 is moved relative to the blades 24 and 26 to properly position the workpiece. Thus, the holder 18 is mounted on a carriage 34 which is movable into and out of the sheet as viewed in the drawing. The carriage 34 moves along a cross bar 36 which is mounted on guide rails 38 for movement toward and away from the shearing machine 16. During movement of the workpiece 10 by the holder 18, the workpiece engages upwardly projecting transfer balls 42 which are spring loaded and support the workpiece for movement toward and away from the shearing machine.

After one or more cutting operations have been completed, a relatively small scrap or remainder piece 10*a* is gripped by the holder 18. Since the remainder or scrap piece 10*a* is relatively small, the scrap piece may drop into a clearance space 46 between the discharge conveyor 30 and the stationery blade 24. Thus, if the holder 18 is actuated to release the remainder or scrap piece 10*a* when the holder 18 is disposed to the left (as viewed in the drawing) of the blades 24 and 26 the scrap piece 10 may fall into the clearance space 46.

To prevent the scrap or remainder piece 10*a* from falling into the clearance space 46, the cross slide 36 is moved toward the shearing machine 16 through a sufficient distance to have the holder 18 extend into the space between the blades 24 and 26 and projects over the discharge conveyor 30. The holder 18 is then operated to release the scrap or remainder piece 10*a*. Since the holder 18 extends over or is at least disposed closely adjacent to the conveyor 30, the scrap or remainder piece 10*a* falls onto the conveyor 30. The scrap or remainder piece 10*a* can then be carried away by the discharge conveyor 30. Therefore, the scrap or remainder piece 10*a* does not fall into the clearance space 46 between the discharge conveyor and the stationary blade 24.

What is claimed is:

1. A method of operating an apparatus to cut scrap pieces off a sheet material workpiece to form a sheet material article of a desired configuration, said method comprising the steps of gripping the workpiece with a holder, moving the holder to position the workpiece between a pair of blades, effecting relative movement between the blades to cut a first scrap piece off of the workpiece, dropping the first scrap piece onto a conveyor which is separated from the blades by a clearance space and is disposed on a side of the blades opposite from the holder, subsequently moving the holder to change the position of the workpiece relative to the blades, cutting the article off of the workpiece to leave a second scrap piece in the holder, depositing the article on the cnveyor and moving the article away from the holder with the conveyor while gripping the second piece of scrap with the holder, thereafter extending the holder between the blades and across the clearance space to a location adjacent the conveyor, and dropping the second scrap piece onto the conveyor by actuating the holder to release the second scrap piece while the holder extends between the blades and across the clearance space.

* * * * *

UNITED STATES PATENT AND TRADEMARK OFFICE

CERTIFICATE OF CORRECTION

PATENT NO. : 4,448,099

DATED : May 15, 1984

INVENTOR(S) : Naoki Kuroda and Kimihiro Tsuge

It is certified that error appears in the above–identified patent and that said Letters Patent are hereby corrected as shown below:

Column 2, line 51, change "cnveyor to - - conveyor - -.

Signed and Sealed this

*Fourth* Day of *September 1984*

[SEAL]

*Attest:*

GERALD J. MOSSINGHOFF

*Attesting Officer*

*Commissioner of Patents and Trademarks*